United States Patent [19]

Lovick

[11] Patent Number: 5,030,939

[45] Date of Patent: Jul. 9, 1991

[54] MULTIPLE INPUT SIGNAL CHECKING CIRCUIT

[75] Inventor: David E. Lovick, Garfield Heights, Ohio

[73] Assignee: Elsag International B.V.

[21] Appl. No.: 406,990

[22] Filed: Sep. 14, 1989

[51] Int. Cl.[5] ..... G08B 23/00

[52] U.S. Cl. ..... 340/500; 340/525; 340/506; 340/507; 340/508; 340/511

[58] Field of Search ..... 340/500, 525, 506, 507, 340/508, 511, 870.09, 870.21, 870.16

[56] References Cited

U.S. PATENT DOCUMENTS

| | | | |
|---|---|---|---|
| 4,578,669 | 3/1986 | Woods | 340/500 |
| 4,586,144 | 4/1986 | Fukumoto | 340/500 |
| 4,626,831 | 12/1986 | Engel | 340/500 |
| 4,808,971 | 2/1989 | Graham et al. | 340/500 |

*Primary Examiner*—Donnie L. Crosland

*Attorney, Agent, or Firm*—Robert J. Edwards; Vytas R. Matas; Eric Marich

[57] ABSTRACT

A circuit senses the conditions of control instrumentation such as valves and graphically displays these conditions on a display panel or screen of a console. The circuit also provides signal checking or validation capability monitoring the quality of the instrument condition signals and displaying the quality of the monitored signals on the same console screen.

3 Claims, 1 Drawing Sheet

MULTIPLE INPUT SIGNAL CHECKING CIRCUIT

FIELD OF THE INVENTION

The present invention relates generally to circuits for sensing the conditions of control instruments such as valves and particularly to such circuits which also provide a check or validation of the quality of the instrument condition signal.

BACKGROUND OF THE INVENTION

Prior art circuitry provided for circuits which would monitor the conditions of instruments such as valves and provide an indication of such conditions to an operator by way of control signals to the console graphics which were viewed by the operator. Thus the operator, by viewing the console graphics would know whether the valve was fully opened, fully closed or possibly in mid-travel between these two positions. Since the mid-travel indication of the valve could also be due to a failure in the valve condition sensing, mid-travel measurement was not reliable since it could be caused by either the valve actually being in mid-travel or a failure of the instrument sensors.

Thus there is a need for a reliable circuit that would not only provide the operator an indication of the instrument's condition, such as a valve being opened, closed, or in a mid-travel position, but also one which would provide the operator an indication that the actual sensing instrument was faulty.

SUMMARY OF THE INVENTION

The present invention solves the problems associated with the prior art circuits as well as others by providing a circuit for sensing the condition of control instruments such as valves and graphically displaying these conditions on a display panel or screen along with a display of the quality of the instrument sensors.

To accomplish this the signals from the instrument sensors are monitored by a test quality subcircuit which produces a digital output signal if any of the input signals thereto are bad and which outputs this digital signal to a transfer station for effectively preventing the passage of the normal signals indicative of valve condition and instead passing a signal indicative of the failure of the valve sensing circuitry.

Under normal conditions, the transfer circuit allows the signals indicative of valve condition to pass through to circuitry which drives the console graphics and provides the normal indications of a valve being open, closed or in mid-travel. When inhibited by a signal from the test quality unit, the transfer station provides an alarm signal and signals the console graphics to indicate the failure of the sensing circuitry for the valve.

In view of the foregoing it will be seen that one aspect of the present invention is to provide for a circuit which tests the signal quality or validity of normal valve condition signals.

Another aspect of the present invention is to provide a circuit which provides an alarm signal or alarm display to console graphics indicating the failure of the instrument sensors.

These and other aspects of the present invention will be more clearly understood from a review of the following description of the preferred embodiment when considered in conjunction with the associated drawings.

DESCRIPTION OF THE PREFERRED EMBODIMENT

Figure 1:
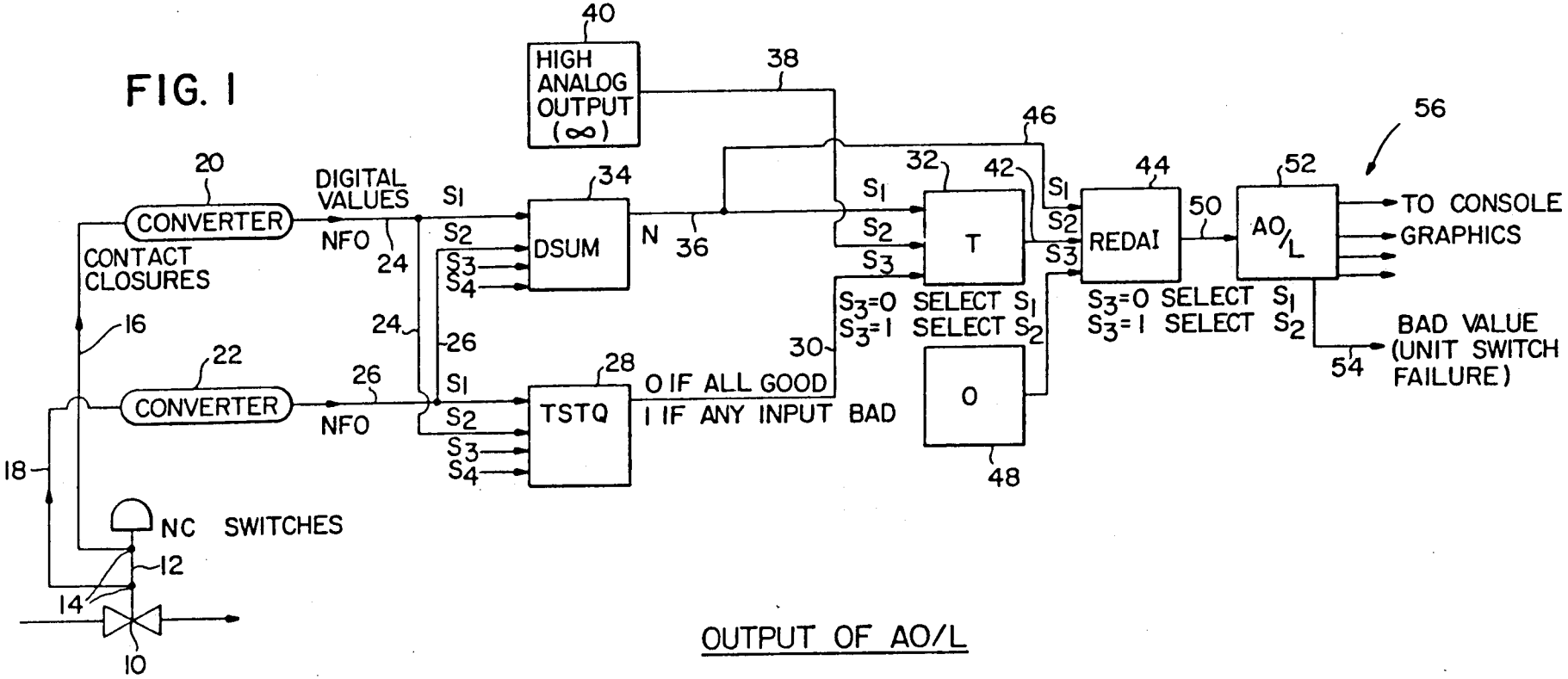
FIG. 1 is schematic of the present invention.

Turning now to the drawings wherein the showings are intended to disclose a preferred embodiment of the present invention without limiting the invention thereto, it is noted that FIG. 1 represents a circuit in function block form. The circuit in FIG. 1 takes signals based on the condition of a valve 10 and then processes these signals to produce appropriate output control signals to an operator console (not shown) which provides graphic displays to the operator indicative of the conditions of various process instruments such as the valve 10.

Each function block represents a well known microprocessor based control module which is programmed to provide certain outputs based on the conditions of its inputs.

The valve 10 has a valve stem 12 which has normally closed switches 14 located at appropriate locations along the stem 12 to be actuated by the appropriate movement of the stem 12 to the open position. This actuation could be accomplished in any number of well known means such as the placement of an actuator ring or dimple on the stem 12 which actuates the normally closed switches 14 into an open position preventing the flow of current along lines 16 and 18.

Thus, when the stem 12 is in its fully retracted position out of the valve 10, the normally closed switch 14 associated with the line 16 is opened preventing the flow of current to converter 20. Similarly, when the valve stem 12 is fully inserted into the valve 10, the normally closed switch 14 associated with line 18 is opened and the flow of current is prevented to converter 22. When the stem 12 is in mid-travel between its fully extended and fully inserted positions, both of the normally closed switches 14 are closed and electric current is thereby provided to both converters 20 and 22.

Figure 2:
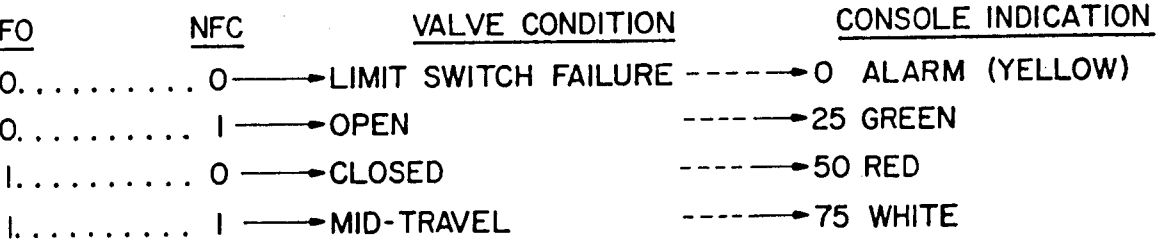
FIG. 2 is a graphical correlation of the instrumentation signals correlated to the instrument condition and the console indication.

The converters 20 and 22 are signal converters which produce digital outputs along lines 24 and 26, respectively, in response to either the presence or absence of electric current in lines 16 and 18. Thus, turning briefly to FIG. 2, it can be seen that when the valve 10 is fully open as indicated by the stem 12 actuating the normally closed switch 14 in line 16, no electric current flows to the converter 20. The output along line 24 thus has a digital value of zero. The normally closed switch 14 associated with line 18 has current flowing therethrough and the converter 22 thus has an output with a digital value of one along line 26. When the valve stem 12 is fully inserted into the valve 10, the actuation of the normally closed switches 14 is reversed and the digital values along lines 24 and 26 are reversed to a digital value of one along line 24 and zero along line 26. Also when the valve stem 12 is in mid-travel between the normally closed switches 14 there is provided an electric current along both lines 16 and 18. The converters 20 and 22 then produce digital output signals of one along both lines 24 and 26. These discussed digital outputs, as seen in FIG. 2, correlate the digital outputs from lines 24 and 26 and designate them NFO and NFC, respectively, i.e., not fully open and not fully closed, which represents the actual condition of the valve 10. If a failure occurs in the normally closed switches 14, or if there is a break in lines 16 or 18, this causes a zero current flow to the converters 20 and 22 which produces a continuous digital value of zero along both lines 24 and 26. This condition is indicated as a limit switch failure signal condition as shown in FIG. 2. Additionally, the converters 20 and 22 check for a signal quality (signals are good or bad) and outputs this indication along with the valve position logic one and zero signals to the D-SUM34 and the TSTQ28 which exclusively react to only the logic and the quality outputs, respectively.

Turning to FIG. 1, it is seen that the logic outputs of lines 24 and 26 are inputted to a test quality function block 28 through inputs designated as $S_1$ and $S_2$. The test quality function block 28 is a programmed microprocessor that checks the signal quality of up to four inputs designated as $S_1$ through $S_4$. It is a four input logical OR function that sets an output along line 30 to a logic zero if all the connected inputs are good and to a logic one if one or more of the connected inputs are bad. Thus, viewing the NFO and NFC logical conditions in FIG. 2, there is always at least one logic one input to the test quality function block 28 for the valve 10 opened, closed or in mid-travel condition. Accordingly, for all normal conditions the output of the test quality function block 28 is a logic zero to the input $S_3$ of an analog transfer function block 32. If a limit switch failure should occur, a logic zero results for all of the inputs of the test quality function block 28 to produce a logic one output signal which is sent to the analog transfer function block 32 along line 30 to the input $S_3$.

The logic outputs of converts 20 and 22 are also input along respective lines 24 and 26 into a DSUM (digital sum with gain) function block 34 to two of a possible four inputs, $S_1$ through $S_4$. The DSUM function block 34 computes the weighted sum of up to four Boolean inputs using the following equation for output N:

$$N=AS_1+BS_2+CS_3+DS_4$$

The constants A, B, C and D are programmed constants inherent in the DSUM function block 34 which are added or not depending upon the zero or one value of the Boolean input. In this particular case, only two inputs, $S_1$ and $S_2$, are used having a weighted constant of 25 and 50, respectively. Again referring to FIG. 2, the output N of the DSUM function block 34 has a numerical value of 25 for the valve 10 in an open condition since only the B value of 25 is factored in the N output. Similarly, an N output of 50 is provided for the valve 10 in a closed condition since only the 50 value for A is in effect. In a mid-travel condition, both the values of A and B are in effect which yields a value of 75 for the output N to indicate the mid-travel condition. In the event of a limit switch failure, both logic signals are zero and when multiplied by the A and B constants give a zero value for N, representing the limit switch failure condition. The aforementioned values for N are thus outputted along line 36 from the DSUM function block 34 to the $S_1$ input of the analog transfer function block 32. The remaining input, $S_2$, to the analog transfer function block 32 is inputted along line 38 from a high analog output function block 40. This function block 40 produces an extremely high numerical output on a constant level.

Thus, the three inputs to the analog transfer function block 32 are comprised of: the four possible numerical values for N from the DSUM function block 34 through the $S_1$ input; the constant high analog value from the high analog output function block 40 by way of the $S_2$ input; and the logic zero or one input signal to the $S_3$ input from the test quality function block 28.

The analog transfer function block 32 functions to select either the $S_1$ input or the $S_2$ input as its output along line 42. This depends on the condition of the Boolean input to $S_3$. If the input to $S_3$ is a logic zero, then the output along line 42 is selected as the $S_1$ input. If the input to $S_3$ is a logic one, then the analog transfer function block 32 selects the $S_2$ input as its output along line 42. The end result is that the analog transfer function block 32 passes a high analog output signal when the test quality function block 28 determines that there is a failure of the limit switch 14. Otherwise the normal valve condition signals from the DSUM function block 34 pass through when the test quality function block 28 does not indicate a limit switch failure.

The output of the analog transfer function block 32 also serves as the $S_2$ input of a redundant analog input (REDAI) function block 44. This function block 44 also has an input at $S_1$ directly from the DSUM function block 34 along line 46. There is a third input to the REDAI function block 44 at $S_3$ from a zero default function block 48.

The redundant analog input function block 44 is used as a transfer between a pair of redundant analog signals. This transfer is controlled by an external logic select input to $S_3$The output value is equal to the input value selected with the input $S_3$. This function code also checks the difference between the two inputs and the rate of change of the selected input. The output quality is considered bad if the quality of the selected input is bad. Essentially, this happens if the rate of change exceeds the rate limits specified, or if the difference between the two inputs is larger than a predetermined value. In operation, the redundant analog input function block 44 passes the output of the DSUM function block 34 since the $S_3$ input is preset to a logic zero. As a secondary function, it compares the normal signals from the DSUM function block 34 inputted to $S_1$ with the output from the analog transfer function block 32. It should be recalled that the analog transfer function block 32 normally passes the same signal as the DSUM function block 34 output N. Thus, the redundant analog input function block 44 for such a comparison passes the signal. When the analog transfer function block 32 senses a limit switch failure it passes the high analog output 40 as the input to $S_2$ of the redundant analog input function block 44 which then compares it with the normal output of the DSUM function block 34. The difference causes the redundant analog input function block 44 to generate an alarm condition indicative of a bad valve 10 or a limit switch failure.

The output of the redundant analog input function block 44 is connected along line 50 to an analog exception report function block 52. The function block 52 causes the input value 50 to be sent on to the console graphics for display on the screen (not shown) in response to the normal outputs from the redundant analog input function block 44. Also, when the time limit or a significant change in the redundant analog inputs to the function block 44 are exceeded, it generates an alarm indicative of the bad valve 10 in output 54.

Referring now to both FIGS. 1 and 2, it is seen that when there is a limit switch failure the output of the function block 52 is zero. The console graphics shows an alarm condition indicated by the color yellow and an audible alarm sounded by way of line 54 to indicate either a bad valve 10 or limit switch failure. For normal valve open position the function block 52 outputs a numerical value of 25 to the console graphics which shows this value along with a color green. For normal valve closed operation, the function block 52 outputs a numerical value of 50 which is displayed on the console graphics along with the color red. Similarly, for a mid-travel normal valve condition the console graphics shows a value of 75 along with the color white.

It should be understood that certain improvements and modifications have been deleted herein for the sake of conciseness and readability but are intended to be properly included within the scope of the following claims.

I claim:

1. A circuit which provides an indication of the condition of a control instrument (10), based upon signals received from control instrument sensor means (14) associated therewith, which also provides an indication of whether or note the sensor means (14) are faulty, comprising:

control instrument sensor means (14) for producing signals indicative of sensed conditions of the control instrument (10);

means (20,22) for producing first digital output signals indicative of the sensed condition of the control instrument (10) and second digital output signals indicative of the quality of the sensed condition signals;

means (34) for producing an output signal N, based upon the first digital output signals, indicative of the sensed condition of the control instrument (10);

means (28) for producing third digital output signals, based upon the second digital output signals, indicative of whether or note the sensor means (14) are faulty;

means (40) for producing a constant level, high numeric value analog signal;

means (32) for producing a selected signal of either the output signal N or the constant level, high numeric value analog signal, the selecting means (32) selecting the output signal N if the third digital output signals indicate that the sensor means (14) are not faulty, and selecting the constant level, high numeric value analog signal otherwise, the selected signal produced being indicative of the sensed condition of the control instrument (10); and means (52) for producing a display signal, based upon the selected signal, indicative of the sensed condition of the control instrument (10), the display signal being a numeric value indicative of the sensed condition of the control instrument (10) and whether the control instrument sensor means (14) are faulty.

2. The circuit of claim 1, further including means (44) for producing a transferred signal, based upon an external logic select value provided as a first input to the means (44) for producing a transferred signal, the transferred signal being selected from one of either the output signal N provided as a second input thereto or the constant level, high numeric value analog signal provided as a third input thereto.

3. The circuit of claim 2, wherein the means (52) for producing a display signal transmits the transferred signal therethrough as the display signal.

* * * * *